United States Patent [19]

Green et al.

[11] Patent Number: 4,934,484

[45] Date of Patent: Jun. 19, 1990

[54] DESCENDING LIFE SAVING DEVICE

[76] Inventors: Kenneth E. Green; Grace M. Green, both of 2278 Old Hwy. 158, Belleville, Ill. 62221

[21] Appl. No.: 390,114

[22] Filed: Aug. 7, 1989

[51] Int. Cl.[5] ..... A62B 1/20; A62B 35/00

[52] U.S. Cl. ..... 182/5; 182/72; 188/65.4

[58] Field of Search ..... 182/5, 6, 7, 72; 188/65.1–65.5

[56] References Cited

U.S. PATENT DOCUMENTS

| | | | |
|---|---|---|---|
| 682,082 | 9/1901 | Ives | 182/7 |
| 702,858 | 6/1902 | Hendricks et al. . | |
| 1,190,389 | 7/1916 | Erwin . | |
| 1,357,772 | 11/1920 | Godwin | 182/6 |
| 2,979,028 | 4/1961 | Zakely | 182/6 |
| 4,476,959 | 10/1984 | Eger | 182/193 |
| 4,580,658 | 4/1986 | Brda | 182/5 |
| 4,679,654 | 7/1987 | Lu | 182/5 |
| 4,705,142 | 11/1987 | Peterson | 182/150 |

*Primary Examiner*—Reinaldo P. Machado
*Attorney, Agent, or Firm*—Ansel Group

[57] ABSTRACT

A portable assembly comprising a nylon flame retardant support rope, an adjustable size waist band and crotch harness and a lever controlled brake rope friction device. The user securely fastens the rope at the point of departure, threads the rope through the friction device and fastens the device to the harness. The lever on the friction device regulates the rate of descent from a full stop to the limiting rate prescribed by the friction ring assembly. Alternately, the user may hand hold the friction device for lowering a load fastened to the harness.

10 Claims, 1 Drawing Sheet

DESCENDING LIFE SAVING DEVICE

BACKGROUND OF THE INVENTION

1. Field of the Invention

The present invention pertains to devices for frictionally controlling a person's descent on a rope-like material suspended form a building or other elevated structure.

2. Description of the Realated Art

Two pertinent prior art patents of the many prior art patents are: U.S. Pat. No. 4,580,658 Brda and U.S. Pat. No. 4,476,956 Eger. The Brda patent discloses a friction cylinder and a pivotally mounted control around which passes the descending rope. The rope then pases between a concave braking surface. Manually positioning the braking surface control lever controls the rated of descent of the device. The Eger patent discloses a device in which the descending rope encircles a helical rotatale cam with means for adjusting the friction and thus the rate of descent.

SUMMARY OF THE INVENTION

The present invention describes a portable emergency evacuation kit, including 400 feet of flame retardant rope, a safety harness and a descent control feeder apparatus. The harness utilizes a strong chest band member connected by a metal buckel to a transverse member passing through the crotch of the user. The descent control unit is fastened to the metal buckle on the harness. After removing the cover from the device enclosure, the user fastens the nylon rope to a secure object, passes the rope through friction brake on the descent control and by manipulating the brake lever on the control thereby controlling his rate of descent. The nylon rope passing between friction pins is further frictionally constrained by winding through a friction ring attached to the top of the control unit.

A apparaus for frictionally controlling a rate of descent of an object by engaging a load support line connected to the object having the support line engaging a lever operated brake rotatively fastened on a brake side of a device enclosure to restrict the movement of the support line.

The support line enters the device enclosure through an entrance port in the brake side of the device enclosure adjacent to the brake and extends downwardly in the device enclosure to a plurality of horizontally placed, vertically spaced cylindrical rods mounted on an inside surface of a rod mounting side of the device enclosure where the support line makes an approximate 180 degrees turn upwardly by passing between, the horizontally placed rods.

There is a friction ring mounted in a mounting port in a top of the device enclosure and having an attachment ring with a first opening thereon that extends beyond an outside surface of the top of the device enclosure. The support line continues upwardly to enter a first side of a second opening formed in the friction ring and passes through the second opening of the friction ring. The support line wraps around a top support structure of the friction ring, entering a second side of the second opening of the friction ring, passes through the opening, extends downwardly and passes through an exit port formed in a bottom of the device enclosure.

There is a removable cover that forms one side of the device enclosure opposite the rod mounting side to allow access to a inner chamber of the device enclosure.

The apparatus may have an interior partition wall to isolate the cylindrical rods from the support line as the support line approaches the exit port and a safety harness means to support a person connected to the attachment ring.

The apparatus could be supplied in a kit form ready to be put in place at the evacuation site. The support line or rope could be made of fire resistant nylon and be 400 feet in length. However the rope could be made of any fire resistant material and be of any necessary length. The cylindrical rods are also referred to as a means for threading in claim 4. The descent control feeder apparatus is referred to and has a means for attaching 20 to the buckle. A means for breaking the rope is referred to and is shown in the drawings as brake 42.

DETAILED DESCRIPTION OF THE PREFERRED EMBODIMENTS

Figures 1, 2:
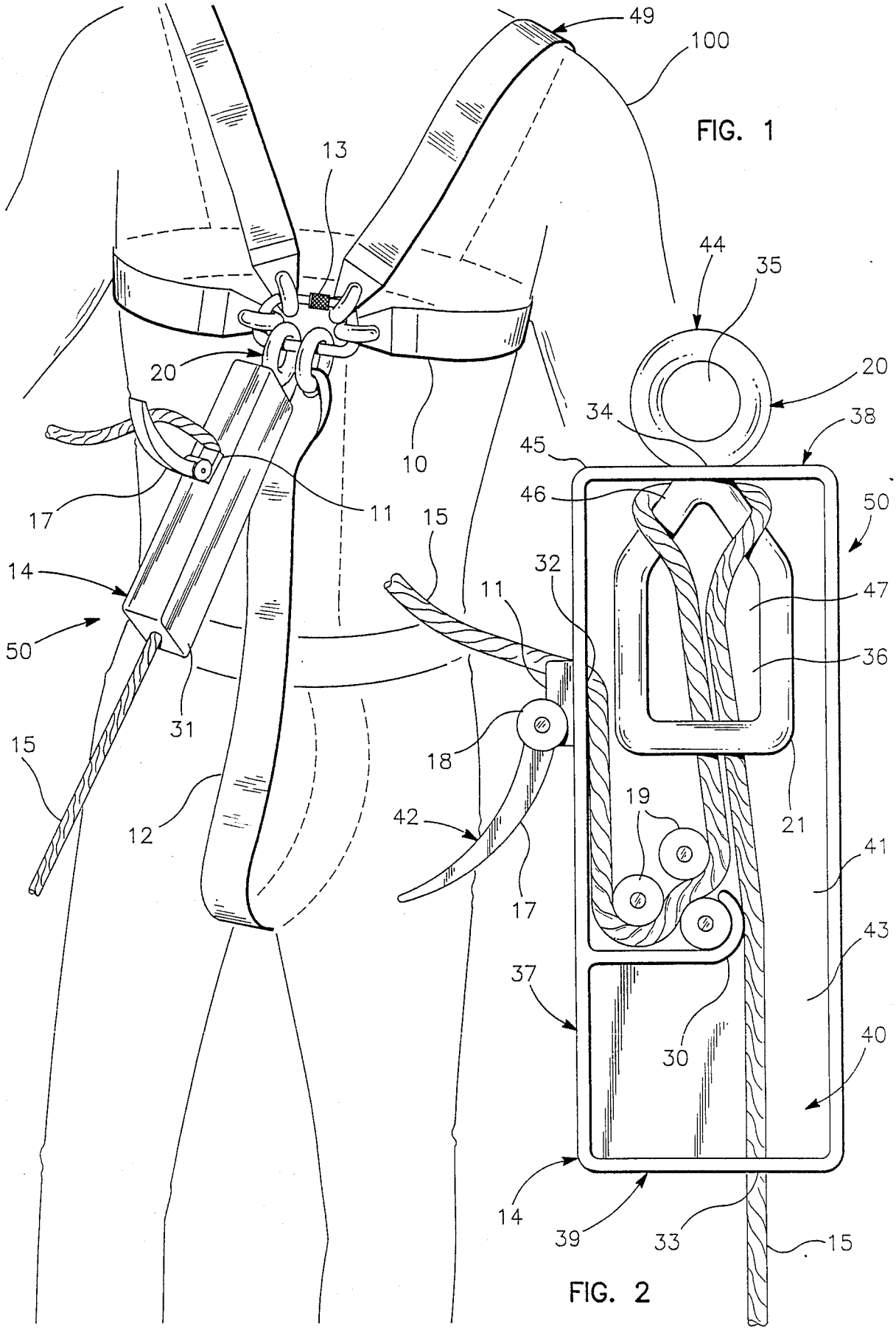
FIG. 1, is a perspective view of the harness and descent control device attached to the user.
FIG. 2, is a perspective view of the descent control device with the cover removed.

An apparatus 50 is shown in FIGS. 1 and 2. An apparatus 50 for frictionally controlling a rate of descent of an object 100 by engaging a load support line 15 connected to the object 100 having the support line 15 engaging a lever operated brake 42 rotatively fastened on a brake side 37 of a device enclosure 14 to restrict the movement of the support line 15 is shown. The brake 42 has a lever 17, a friction brake pad 11 and a pivot 18. The brake 42 can be used to slow a rate of descent or to completely stop the descent of the person or object 100.

The support line 15 enters the device enclosure 14 through an entrance port 32 in the brake side 37 of the device enclosure 14 adjacent to the brake 42 and extends downwardly in the inner chamber 41 of the device enclosure 14 to a plurality of horizontally placed, vertically spaced cylindrical rods 19 mounted on an inside surface 43 of a rod mounting side 40 of the device enclosure 14 where the support line 15 makes an approximate 180 degrees turn upwardly by passing between the horizontally placed rods 19.

There is a friction ring 20 mounted in a mounting port 34 in a top 38 of the device enclosure 14 that has an attachment ring 44 with a first opening 35 thereon that extends beyond an outside surface 45 of the top 38 of the device enclosure 14. The support line 15 continues upwardly to enter a first side or bottom 21 of the a second opening 36 formed in the friction ring 44 and passes through the second opening 36 of the friction ring 44. The support line 15 wraps around a top support structure 46 of the friction ring 44, entering a second side 47 of the second opening 36 of the friction ring 44, passes through the opening 36, extends downwardly and passes through an exit port 33 formed in a bottom 39 of the device enclosure 14.

There is a removable cover 31 that forms one side of the device enclosure 14 opposite the rod mounting side 40 to allow access to an inner chamber 41 of the device enclosure 14. FIG. 2 shows the apparatus 50 with the cover 31 removed from the device enclosure 14. FIG. 1 shows the cover 31 in place.

There is an interior partition wall 30 to isolate the cylindrical rods 19 from the support line 15 as the support line 15 approaches the exit port 33. The partition wall 30 also aligns the support line 15 with the exit port 33. There is a safety harness means 49 to support a person or an object 100 connected to the attachment ring 20. The harness has a breast band 10 with a crotch transverse member 12 and a releasable metal buckle ring 13 that passes through the rings of the straps of the safety harness and through the attachment ring 20.

In use the person 100 desiring to descend is strapped into the harness 49, the harness attached to the attchment ring 20 of the apparatus 50, the brake 42 engaged on the support line 15 securely and the brake released slowly and steadily as the person descends down a side of a building until the person determines a safe rate of descent for him or herself. The rate of descent may be completely stopped if the user desires. The apparatus 50 may be hand held by a third person and the support line 15 can be attached to a load such as a person and the load descent controlled by the third person.

We claim:

1. An apparatus for frictionally controlling a rate of descent of an object by engaging a load support line connected to the object comprising:

a. the support line engaging a lever operated brake rotatively fastened on a brake side of a device enclosure to restrict the movement of the support line;

b. the support line entering the device enclosure through an entrance port in the brake side of the device enclosure adjacent to the brake;

c. the support line extending downwardly in the device enclosure to a plurality of horizontally placed, vertically spaced cylindrical rods mounted on an inside surface of a rod mounting side of the device enclosure where the support line makes an approximate 180 degrees turn upwardly by passing between the horizontally placed rods;

d. a friction ring mounted in a mounting port in a top of the device enclosure and having an attachment ring with a first opening thereon that extends beyond an outside surface of the top of the device enclosure;

e. the support line continuing upwardly to enter a first side of a second opening formed in the friction ring and passing through the second opening of the friction ring;

f. the support line wrapping around a top support structure of the friction ring, entering a second side of the second opening of the friction ring, passing through the opening, extending downwardly and passing through an exit port formed in a bottom of the device enclosure; and g. a removable cover that forms one side of the device enclosure opposite the rod mounting side to allow access to a inner chamber of the device enclosure.

2. A apparatus as described in claim 1 further comprising an interior partition wall to isolate the cylindrical rods from the support line as the support line approaches the exit port.

3. A apparatus as described in claim 1 further comprising a safety harness means to support a person connected to the attachment ring.

4. A portable emergency evacuation kit for use in evacuating a person from a building comprising:

a length of rope;

a safety harness for the person to wear, the harness including a buckle;

a descent control feeder apparatus in an enclosure having a removable cover and having a plurality of port means to allow ingress and egress of the rope to and from the enclosure including means for attaching to the buckle and means for threading the rope through the apparatus to control the rate of descent of the person; and a friction ring attached to a top of the apparatus.

5. The kit of claim 4 wherein the means for threading includes three horizontally placed and vertically spaced cylindrical pins.

6. The kit of claim 4 wherein the ring further includes a bottom and the rope is threaded between the pin and through a bottom of the ring.

7. The kit of claim 4 wherein the appartus further comprises means for braking the rope from moving through the appratus.

8. The kit of claim 4 wherein the rope is four hundred feet in length.

9. The kit of claim 4 wherein the rope is a flame retardant nylon rope.

10. A portable emergency evacuation kit for use in evacuating a person from a building comprising:

a. a length of rope;

b. a safety harness for the person to wear, the harness including a buckle;

c. a descent control feeder apparatus in an enclosure having a removable cover and having a plurality of port means to allow ingress and egress of the rope to and from the enclosure including a means for attaching the apparatus to the buckle of the safety harness and a means for threading the rope through the apparatus to control a rate of descent of the person;

d. a friction ring attached to a top of the apparatus;

e. the means for threading including three horizontally placed, vertically spaced cylindrical pins;

f. the friction ring having a bottom and wherein the rope is threaded between the cylindrical pins and through a bottom ring; and g. a braking means to restrict the movement of the rope through the apparatus.

* * * * *